United States Patent [19]

Nichol et al.

[11] Patent Number: 4,927,160

[45] Date of Patent: May 22, 1990

[54] ELECTRONIC BAG TOSS GAME WITH LIGHT-ACTIVATED DETECTION

[75] Inventors: Thomas W. Nichol, 3765 Maple Wood Ct., Hubertis, Wis. 53033; Edward T. Gisske, Verona, Wis.; Arlyn Johnson, 7350 N. 76th St., Milwaukee, Wis. 53223

[73] Assignees: Thomas W. Nichol, Hubertis; Arlyn Johnson, Milwaukee, both of Wis.

[21] Appl. No.: 351,952

[22] Filed: May 8, 1989

Related U.S. Application Data

[63] Continuation-in-part of Ser. No. 300,134, Jan. 23, 1989.

[51] Int. Cl.[5] ..... A63B 63/00; A63B 71/04

[52] U.S. Cl. ..... 273/371; 273/1 E; 273/382; 273/398; 273/402; 273/415; 273/118 A; 273/127 R; 273/DIG. 26

[58] Field of Search ..... 273/371, 372, 373, 345, 273/382, 398, 402, 410, 415, 2, 3 R, 12, DIG. 26, 49, 52, 1 E, 118 A, 119 A, 121 A, 127 R

[56] References Cited

U.S. PATENT DOCUMENTS

| | | | |
|---|---|---|---|
| 922,717 | 5/1909 | Parker . | |
| 2,585,153 | 2/1952 | Metz | 273/126 A |
| 2,966,561 | 12/1960 | Durant | 273/126 A |
| 3,582,076 | 6/1971 | Keller | 273/415 |
| 3,738,655 | 6/1973 | Feddick et al. | 273/1 GD |
| 3,764,143 | 10/1973 | Takahashi | 273/402 |
| 3,764,144 | 10/1973 | Arthur | 273/16 D |
| 3,892,407 | 7/1975 | Higgins | 273/1 GD |
| 4,013,292 | 3/1977 | Cohen et al. | 273/371 |
| 4,375,289 | 3/1983 | Arthur | 273/371 |
| 4,448,418 | 5/1984 | McNeill | 273/345 |
| 4,524,969 | 6/1985 | Erzmoneit | 273/12 |
| 4,542,905 | 9/1985 | Hooker | 273/127 R |
| 4,763,903 | 8/1988 | Goodwin et al. | 273/371 |
| 4,789,163 | 12/1988 | Warner et al. | 273/1 M |

*Primary Examiner*—Edward M. Coven
*Assistant Examiner*—Jessica J. Harrison
*Attorney, Agent, or Firm*—Fuller, Ryan & Hohenfeldt

[57] ABSTRACT

An automated bag toss game, having a game board surface, with holes formed therein. Items are provided for being tossed toward and into the holes, and the game automatically keeps track of and displays running scores based on which holes the bags fall into. In some embodiments the items are bags containing pellets, "bean bags", and at least some of the pellets have magnetic properties. A wire coil is provided for each hole, disposed beneath the surface, for sensing the passage of the bag into one of the holes and producing a signal corresponding to that hole. An electronic circuit is provided for calculating and displaying a score based upon those signals. The electronic circuit includes a portion for a display for showing the current scores, a display driver portion for controlling the display, and a processor for receiving a signal from the receiving portion corresponding to a predetermined score value of holes in the game board and producing a signal for causing the display driver to show at least a cumulative score corresponding to the holes into which the bags have fallen. One such embodiment is based on the coils not being energized, and the bags containing magnetic pellets. A second embodiment is based on the coils being continually energized with a selected frequency signal, and the bags containing ferromagnetic pellets. A third embodiment is based on a light source and a light sensor being placed under the holes, rather than a wire coil, resulting in the detection of the thrown item being light-activated, rather than magnetically activated.

8 Claims, 8 Drawing Sheets

IC1
CLK
A
B
C
D
E
F
G
H

132

140
124
142
138
136

132
134
144

DETECTOR CIRCUITS
144
144
CONTROL CIRCUIT
96

ELECTRONIC BAG TOSS GAME WITH LIGHT-ACTIVATED DETECTION

CROSS-REFERENCE TO RELATED APPLICATION

This application is a continuation-in-part of Ser. No. 300,134 now pending, filed Jan. 23, 1989, the ownership of which is in common with the present application.

BACKGROUND OF THE INVENTION

This invention relates to an electronic bag toss game, and in particular to a bag toss game that is entirely automatic, having sensors for determining when a bag falls into each particular hole, and having scoring devices for keeping track of and displaying the scores of a number of different players, as determined by which holes each player has thrown each bag.

The basic idea of a bag toss game, also referred to as a bean bag game, is very old indeed. In fact, the Parker patent, U.S. Pat. No. 922,717, is a 1909 patent directed to an improvement of the game, implying that the game existed some time before then. With the Parker invention, however, as with earlier versions of bean bag games, the score had to be computed manually generally after all the bags had been tossed, resulting in a slower and less exciting game.

The Keller patent, U.S. Pat. No. 3,582,076, discloses a target board having electrically conductive areas separated by electrically insulative areas, wherein the conductive areas alternate in the polarity of their connection to a power source. A bean bag with an electrically conductive coating is thrown onto the target board, and the score determined by which conductive areas are connected by the bag coating. The disadvantage of this arrangement is that the conductive areas of the board must be exposed, presenting a hazard to any person touching them. Further, it may be difficult to sense whether contact has been truly made, since the bag may slide from one conductive area to another before it comes to a stop, making contact with a number of different conductive areas along the way. Further, a special bag is required to be used, having a conductive outer coating, which would add to the expense of manufacturing and selling, and therefore playing, the game.

This invention relates to improvements to the apparatus described above and to solutions to the problems raised thereby.

SUMMARY OF THE INVENTION

The invention includes an automated bag toss game, made up of a game board surface, having a plurality of holes formed therein and sensing means for determining whether a bag has passed through any particular hole. In one embodiment, at least one bag is included, containing a plurality of pellets of material therein, at least some of those pellets being constructed of a material having magnetic properties. Magnetic sensing means are disposed generally beneath the game board surface and aligned with the holes, for sensing the passage of the bag into one of the holes and producing a signal corresponding to the particular hole into which the bag passed. Electronic means are provided for receiving the signal and for displaying a score based upon the particular hole into which the bag passed. The magnetic sensing means includes a magnetic coil positioned generally normal to the surface beneath each of the holes. The electronic means includes means for receiving the signal from the magnetic sensing means, means for ensuring that the signal from the magnetic sensing means was not a false signal, means for displaying a score corresponding to the holes into which bags have been thrown, and display driving means for receiving a signal from the ensuring means corresponding to a predetermined hierarchy of holes in the game board and producing a signal for driving the display to show a score corresponding to the hole into which the bag fell. The means for ensuring that the signal received was not a false signal includes an electronic circuit which requires a first pulse, caused by the bag entering the coil, and a second pulse of opposite polarity to the first pulse, caused by the bag exiting the bottom of the coil, before transmitting a signal to the display driving means that a bag has landed in a certain hole. The magnetic sensing means may be of the non-energized type, wherein a bag having magnetic pellets therein passes through a core area of the sensing means thereby causing a current in the coil of the sensing means. Alternatively, the magnetic sensing means may be of the energized type, wherein a bag having unmagnetized pellets of a metal having magnetic properties, passes through the core area of the sensing means, thereby causing a change in the current flow in the coil.

In another embodiment, the sensing means is light-activated, having a light source and a light detector associated with each hole. No special bag or material within the bag is necessary, as long as the bag is quite opaque. When a thrown bag breaks a beam of light between the source and the detector, the detector generates a signal similar in effect to that generated by the magnetic sensor referred to above. The electronic means then receives the signal from the light-activated sensor and computes and displays the score resulting from the various detection signals is receives.

Other objects and advantages of the invention will become apparent hereinafter.

DESCRIPTION OF THE PREFERRED EMBODIMENT

Figure 1:
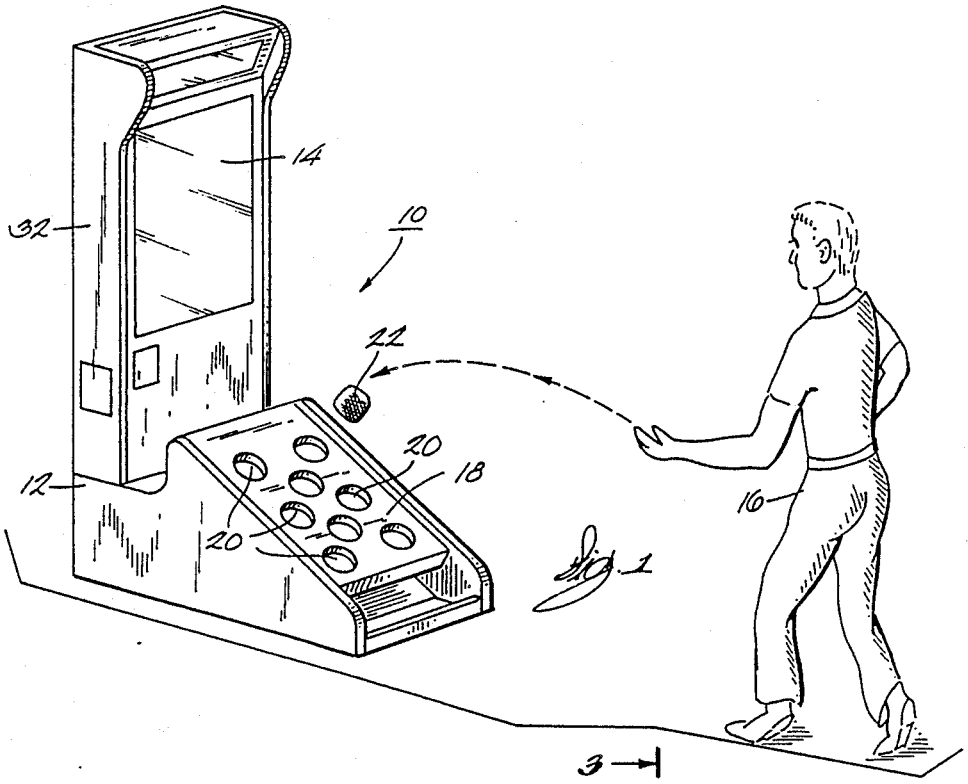
FIG. 1 is an isometric view of a game apparatus constructed according to one embodiment of the invention and showing a person tossing a bag toward the apparatus.

Referring now to FIG. 1, there is shown a game apparatus 10 constructed according to a preferred embodiment of the invention. As can be seen in that drawing figure, the game apparatus 10 includes a frame 12, constructed of any suitable support material, such as wood, metal or plastic. Supported vertically within the frame 12 is a scoring display 14, which is oriented to face a player 16, facing toward the apparatus 10. At the base of the frame 12, and projecting outward toward the player 16 at a descending angle, is a game board 18. The game board 18 is provided with a plurality of holes 20 formed normal to the game board, and arranged variously about the board.

Simply stated, the rules of the game are those of a conventional bag toss game. In the embodiment to be first described, a player 16 is provided with a predetermined number of bags 22 constructed of cloth or similar material, which are filled with pellets 42. That player 16 tries to throw the bags 22 into holes 20 in the game board 18. His score is determined by a predetermined point system, wherein a several of the holes 20 have different point values than others of the holes.

The invention resides in the fact that the game apparatus 10 determines, keeps track of and displays the player's score, along with the scores of a number of other players. This relieves the players of those duties and allows them to concentrate fully on playing the game as well as possible. More particularly, the invention resides in the apparatus itself for determining which hole a bag has been thrown into, and for keeping track of and displaying the score resulting from that determination.

PHYSICAL STRUCTURE

Figure 4:
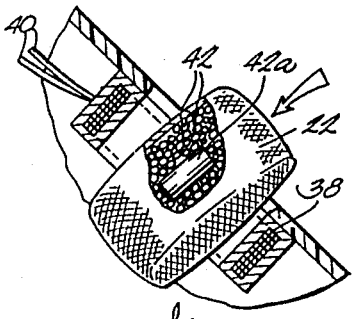
FIG. 4 is an enlarged view of a coil and bag constructed according to one embodiment of the invention.
Figure 3:
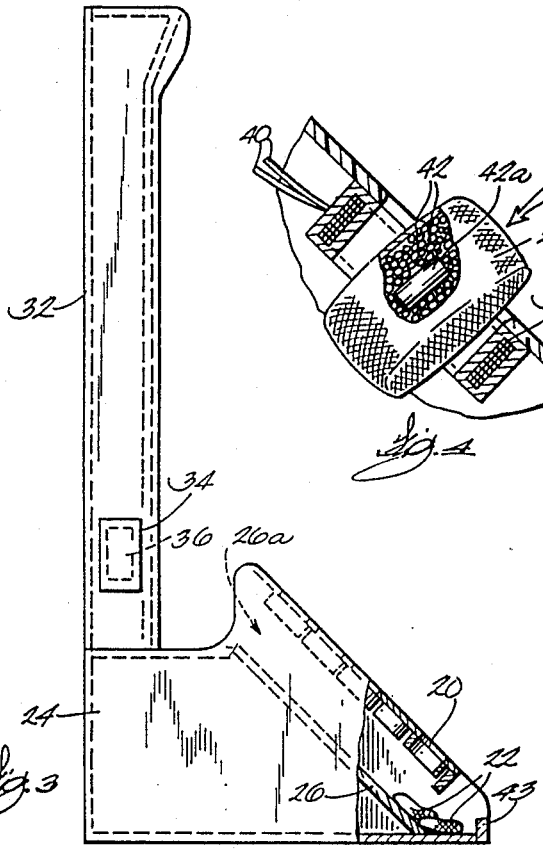
FIG. 3 is a side elevational view of an apparatus as shown in FIG. 2, partially in section along line 3—3 of FIG. 2.
Figure 2:
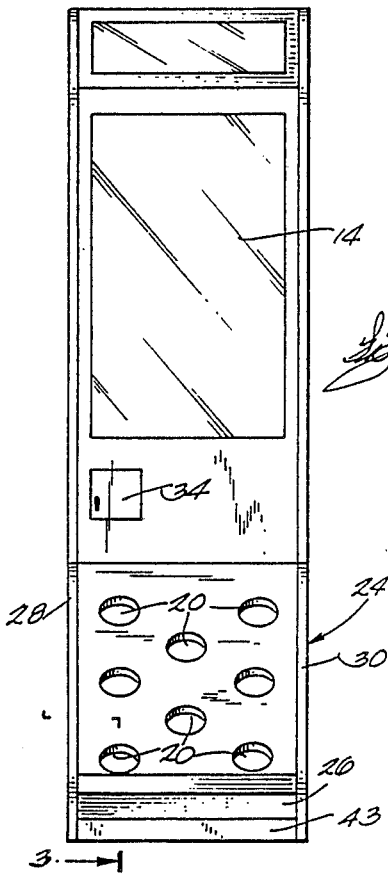
FIG. 2 is a front plan view of an apparatus as shown in FIG. 1.

The physical portion of one embodiment of the apparatus 10 can be seen by reference to FIGS. 2, 3 and 4. While the preferred embodiment is as will be described, the invention encompasses any suitable physical configuration. Referring now to those figures, and as indicated preliminarily above, the apparatus 10 includes a frame 12 for supporting the other parts of the apparatus. The frame 12 includes a base 24, which is basically a rectangular box with the front 26 being slanted outward at the bottom rather than vertical. The two sides 28 and 30 of the base 24 extend beyond the front 26, and provide mounting and support surfaces for the game board 18. Thus game board 18 is supported over the front 26 of the base 24 by the sides 28 and 30, generally parallel to the front, that is, slanted outward at the bottom. The frame 12 further includes an upright 32, also a box but generally vertically elongated. The upright 32 rests on the base 24, toward the back thereof, and holds the scoring display 14 upright in front of the player 16 so that it is readable at a suitable distance. The upright 32 may be provided with one or more access panels 34 to allow access to a coin box (not shown) if the game is to be a coin operated game, and to an electronic control means 36, to be described in more detail presently herein.

As indicated preliminarily above, the game board 18 includes a number of holes 20, formed generally normal to the surface of the game board. The game board 18 further includes, positioned immediately beneath each hole 20, a wire coil 38, shown best in FIG. 4, the central axis of which is also generally normal to the upper surface of the game board. Each such wire coil 38 includes a pair of leads 40 connected to the electronic control means 36. Correspondingly, each bag 22 contains one or more pellets 42*a*. In one embodiment, the pellets 42*a* each hold a magnetic charge. In another embodiment, the pellets 42*a* themselves are not magnetic, but are of a material such as iron that has magnetic effect, that is, a material which could be used as a core for an electromagnet. Hence when a bag 22 passes through a coil 38, an electrical signal is generated in the leads 40, which signal is used by the electronic control means 36 as an indication that a bag has passed into a hole 20.

After the bag 20 does pass through the game board 18, it lands on the front 26 and slides down toward a front stop 43 of the base 24, facilitating retrieval. Hence the front 26 acts as a bag return, presenting the bags 22 at the front of the apparatus 10 for easy recovery of the bags by the next player.

ELECTRONIC CONTROL

Figure 5:
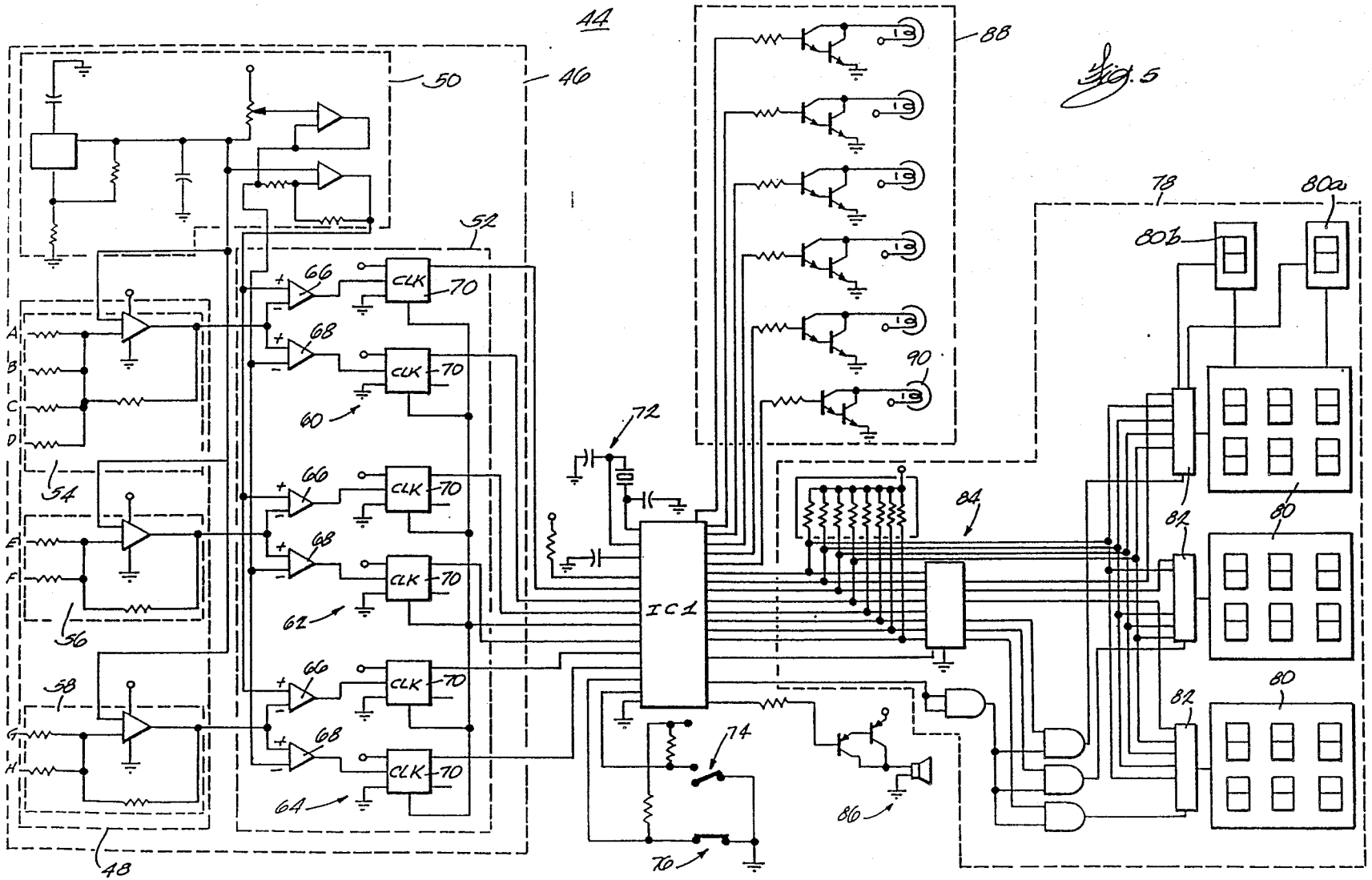
FIG. 5 is a schematic view of one embodiment of an electronic circuit for controlling the display of the apparatus shown in FIG. 1.

Referring now to FIG. 5, there is shown schematically an electronic circuit 44 constructed according to a preferred embodiment of the electronic control means 36. The circuit 44 includes input leads A through H, each of which is connected to a predetermined one of the coils 38 shown in FIG. 4. Each of the leads A through H is connected into a hole determining section 46, the function of which is to determine which value of hole a bag has fallen into. That is, as referred to above, each hole 20 in the game board 18 is assigned a score value, with the object of the game being to maximize a player's score by tossing the bags into the highest score hole possible. Generally, only a few score values will be assigned to a number of holes 20. In the embodiment shown, there are three values assigned to the eight holes 20, two of a first score value, two of a second and four of a third. For instance, two holes 20 may be assigned a score value of 20 points each, two other holes 10 points each and the four remaining holes of the eight hole game board 18 used in this embodiment might be assigned a score value of five points each.

In its preferred embodiment, the hole determining section 46 includes three sub-sections, the amplification means 48, the power supply/conditioning means 50 and the latching means 52. In particular, the input leads A through H are connected to the amplification means 48, since the signal generated by the bag 22 falling through the coil 38 will need amplification before it can be handled by the latching means 52. The power supply/conditioning means 50 supplies the power for the amplification, along with the rest of the power needs of the circuit 44.

Notice that there are only three amplifying circuits 54, 56 and 58, corresponding to the number of score values, that is, three, assigned to the various holes 20. This is because it is not necessary for scoring purposes to determine exactly which hole 20 the bag 22 passed through, but only the score of that hole. This determination is effectively made by connecting the coils 38 from holes 20 of the same score value to the same amplifying circuit, as shown in FIG. 5. Hence, again using the example given above, the four coils 38 from the five point holes are connected to one amplifier 54, the two coils from the 10 point holes are connected to another amplifier 56, and the two coils from the 20 point holes are connected to yet another amplifier 58.

From the amplification means 48, and particularly the amplifier 54, 56 or 58 receiving the signal, the signal is passed on to the latching means 52. The purpose of the latching means 52 is to ensure that a bag 22 has actually passed through hole 20 and its corresponding coil 38, rather than simply passed over or near it and later landed in another hole or off the game board 18 entirely. The basis of the latching means 52 is that the bag 22, containing the one or more magnetic pellets 42*a*, creates in fact two separate pulses of opposite polarity as it passes through the coil 38, one on entering and one on exiting. If a bag 22 falls near the hole but does not pass through it, then it would only create a single pulse, if any at all. Thus the purpose of the latching means 52 is to pass on a signal relating to the respective score value only if both a positive and a negative pulse are received from a single coil 38.

The latching means 52 includes three identical latch circuits 60, 62 and 64. Each such latch circuit 60, 62 and 64 receives the signal, from its respective amplifying circuit 54, 56 and 58, at the inverting terminal of one op amp 66 and the non-inverting terminal of another op amp 68. The output of each of these op amps 66 and 68 is connected to a separate flip-flop 70, and particularly to the clock input CLK thereof. The J input of each flip-flop 70 is connected to a logical high, while the K input of each is connected to a logical low. Finally, the Q output of each flip-flop 70 connects to a separate input to a processor chip IC1. This processor chip IC1 is programmed so that it only counts a bag 22 as having passed through a hole 20 when both of the flip-flops 70 of a particular corresponding amplifier 54, 56 or 58, in turn corresponding to a particular score value of hole 20, send signals. Thus the purposes of selecting the proper score value for the particular bag 22, and ensuring that the particular bag did actually enter the hole rather than pass over it or fall near it, are achieved.

The remainder of the structure of the electronic circuit 44 is relatively straightforward. Besides inputs from the flip-flops 70, processor IC1 has inputs from a clock circuit 72, a coin switch 74, since the embodiment shown is directed toward a coin-operated game, and a next player switch 76, normally a push-button switch, to inform the processor when the next player's turn is starting if the previous player did not throw five bags into holes in his turn. The clock circuit 72 is generally conventional for integrated circuits, and the coin switch 74 and next player switch 76 are generally conventional for coin-operated games.

Turning now to the outputs of the processor IC1, the main output is to a display section 78. While any suitable electronically controlled score display may be used, the display section 78 includes score panels 80 for a total of six players, each panel being an electronic display of three digits of seven segment numbers. The display section 78 further includes a single digit display 80*a* for showing which player is up, and a second single digit display 80*b* for showing how many turns have been taken by the players, that is, the present "frame" of game. Each panel 80 and digit 80*a* and 80*b* is driven by conventional display driver means 82 and display logic means 84, responsive to suitable signals from the processor IC1, to show the score of each player involved in the game, the player up and the frame.

Besides the display section 78, the processor IC1 may have an output to a speaker circuit 86 for making sounds responsive to the actions of the players, and an accessory section 88 for various other functions. Examples of uses for the accessory section 88 include a "Game Over" light 90, which is in a steady ON state at all times except when the game is actually being played, a control 92 for lights associated with the holes 20 to illuminate them during play, and controls 94 for a suitable flashing light display to attract attention to the game apparatus when it is not being played.

GAME LOGIC

The logic of the programming followed by the processor IC1 in controlling the game as described above is shown in a flow diagram in FIGS. 6A, 6B and 6C. The diagram begins at the top of FIG. 6A, with a power up reset. Thereafter, the processor IC1 enters a waiting state, wherein it continually runs the light display, via control 94, and maintains the "Game Over" light on, until a coin is inserted into the apparatus. Once a coin is inserted, the score is zeroed, the light display is stopped, the number of players is incremented, and the processor checks whether another coin is inserted or the first bag is thrown, If another coin is inserted, player number is incremented again, until the maximum number of players, six in the disclosed embodiment, is reached.

If a bag 22 is thrown through a hole 20, the game has effectively begun, and the score is updated according to which hole the bag has passed through. The processor then goes into a "Bag Thrown" loop wherein it checks whether another bag is thrown, or whether the next player button has been pushed, or whether an internal timer maintained by the processor has timed out, or whether another coin has been inserted. If a coin has been inserted, the game is effectively cleared and restarted, ignoring any earlier scores or coins. If the timer times out, the game is not cleared but the "Game Over" light is turned on and the light display is restarted. If the next player button is pushed, the player number is incremented, the frame is incremented if necessary, and the processor waits for another bag to be thrown. However if the last player has finished the last frame, pushing the next player button causes the "Game Over" light and the light display to be turned on.

Finally, if another bag has been thrown, the processor scores that bag and then determines whether the bag just thrown was the last bag of that player's turn. If not, the processor returns to the "Bag Thrown" loop. If the bag just thrown is the last one of the player's turn, the processor determines whether the score is perfect, that is, each bag of the turn having been thrown into one of the holes having the highest score value. If so, sounds are made by the speaker and the lights are flashed. The processor then simply waits for the next player button to be pushed. When it is, the processor determines whether the previous player was the last player, and if not, increments the player and returns to the "Bag Thrown" loop. If the previous player was the last player, then the processor determines whether the previous frame was the last frame and, if not, increments the frame and again returns to the "Bag Thrown" loop. If the previous frame was the last frame, the "Game Over" light is turned on, the light display is started, and the processor returns to its waiting state, waiting for another coin to be inserted.

ALTERNATIVE EMBODIMENT

Figure 7:
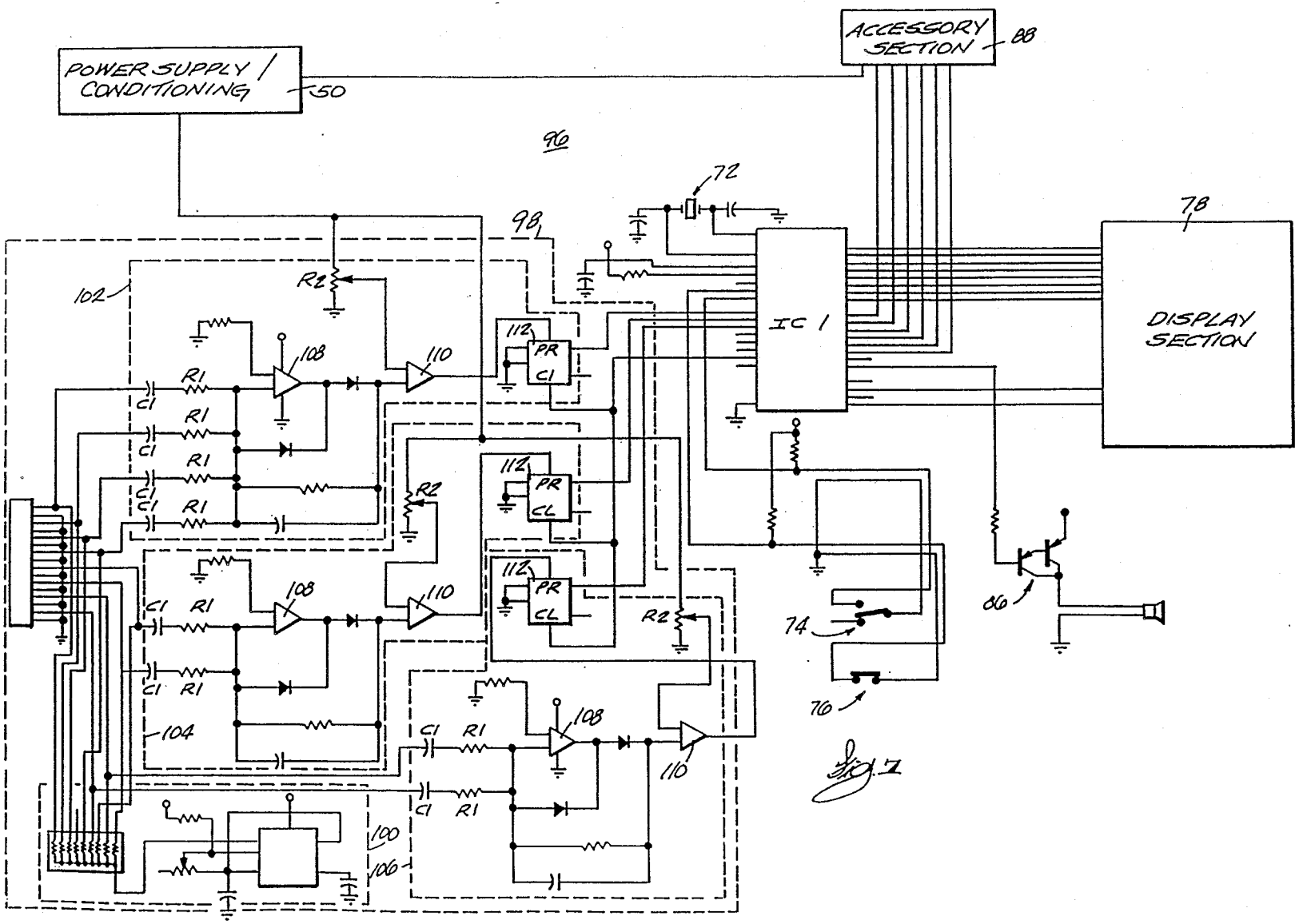
FIG. 7 is a schematic view of an alternative embodiment of an electronic circuit for controlling the display of the apparatus shown in FIG. 1.

Referring now to FIG. 7, there is shown a control circuit 96 constructed according to an alternative embodiment of the electronic control means 36 (FIG. 3). As can be seen by reference to FIG. 7, similar to the electronic circuit 44 shown in FIG. 5, the control circuit 96 includes a circuit display section 78 and the accessory section 88, which are the same as those shown in FIG. 5, and are thus shown here in schematic form, as labeled boxes. The integrated circuit IC1 is still present to drive the display section 78 and the accessory section 88, and also to drive the speaker circuit 86, as was the case with the circuit 44 shown in FIG. 5. Also the same as the circuit 44 shown in FIG. 5 are the switch inputs 74 and 76 for coin detection and next player indication, respectively, and the clock circuit 72. The power supply/conditioning means 50 still supplies the power for amplification, along with the rest of the power needs of the circuit 96, the same as was true for the electronic circuit 44 in FIG. 5, along with supplying a stable five-volt source for the thresholds required in the detection circuit to be set forth presently.

The circuit 96, however, has a hole determining section 98 which is different than that of circuit 44 shown in FIG. 5, because the basis of detection of the passing of a bag into a hole is different in this circuit than was the case in that circuit. Here, the determination of whether a bag has passed through a hole is made by keeping the coils 38 (FIG. 4) continually energized, and measuring changes in the voltage across the coils caused by passage of a bag 22 containing, not magnetized pellets, but pellets containing iron or other ferromagnetic material. Hence, while in the circuit 44 shown in FIG. 5 the passage of a bag 22 causes a current to flow in the respective coil 38, and in turn in the respective leads 40, in the circuit 96 shown in FIG. 7 the passage of a bag 22, containing the ferromagnetic pellets, causes a significant change in the voltage across the coil 38.

In particular, the coils 38 are energized by a coil energizing circuit 100, set to operate at an adjustable frequency. When a bag 22 passes through a coil 38, as shown in FIG. 4, the impedance of the coil is temporarily lowered, and then returned to normal when the bag has finished passing through the coil. This change of impedance in the coil has the effect of changing the resonant frequency of the circuit containing the coil, in turn affecting the voltage across the coil. This change in voltage constitutes a signal to one of three bag detection circuits 102, 104 and 106 that a bag 22 has passed through the particular coil connected to that circuit, thereby indicating that a bag has entered a certain hole. Since some of the holes 20 will, as described earlier, commonly have the same score value, only as many detection circuits 102, 104 and 106 are needed as there are score values. In the embodiment shown in FIG. 7 there are three score values and hence three detection circuits, even though there are eight holes 20.

Each of the detection circuits 102, 104 and 106 has a resistor R1 and a capacitor C1 connected in series between each respective coil lead, and connected in parallel to the input of an op amp 108. Hence, for example, since the circuit 102 has four coils connected to send signals to it, it has four resistors R1 and four capacitors C1, each resistor-capacitor pair being connected in series between the respective coil and the input of the op amp 108. The output of each op amp 108 is connected to one input of another op amp 110, the other input of each op amp 110 being connected to an adjustable resistor R2, in effect for adjusting the threshold value of the signal sent by the respective coil to which the circuit will respond. The output of each op amp 110 is directed to the PR input of a flip-flop 112. Finally, the Q output of each flip-flop 112 is connected to a separate input of IC1. Each flip-flop 112 is then reset by an output of IC1 connected to the CL (clear) input of the flip-flop. Hence by these circuits the signal caused by a bag 22 passing through a particular energized coil 38 is assigned a score within IC1, that score being added to the player's total score and displayed exactly as described with respect to FIG. 5.

LIGHT-ACTIVATED EMBODIMENT

Figure 6:
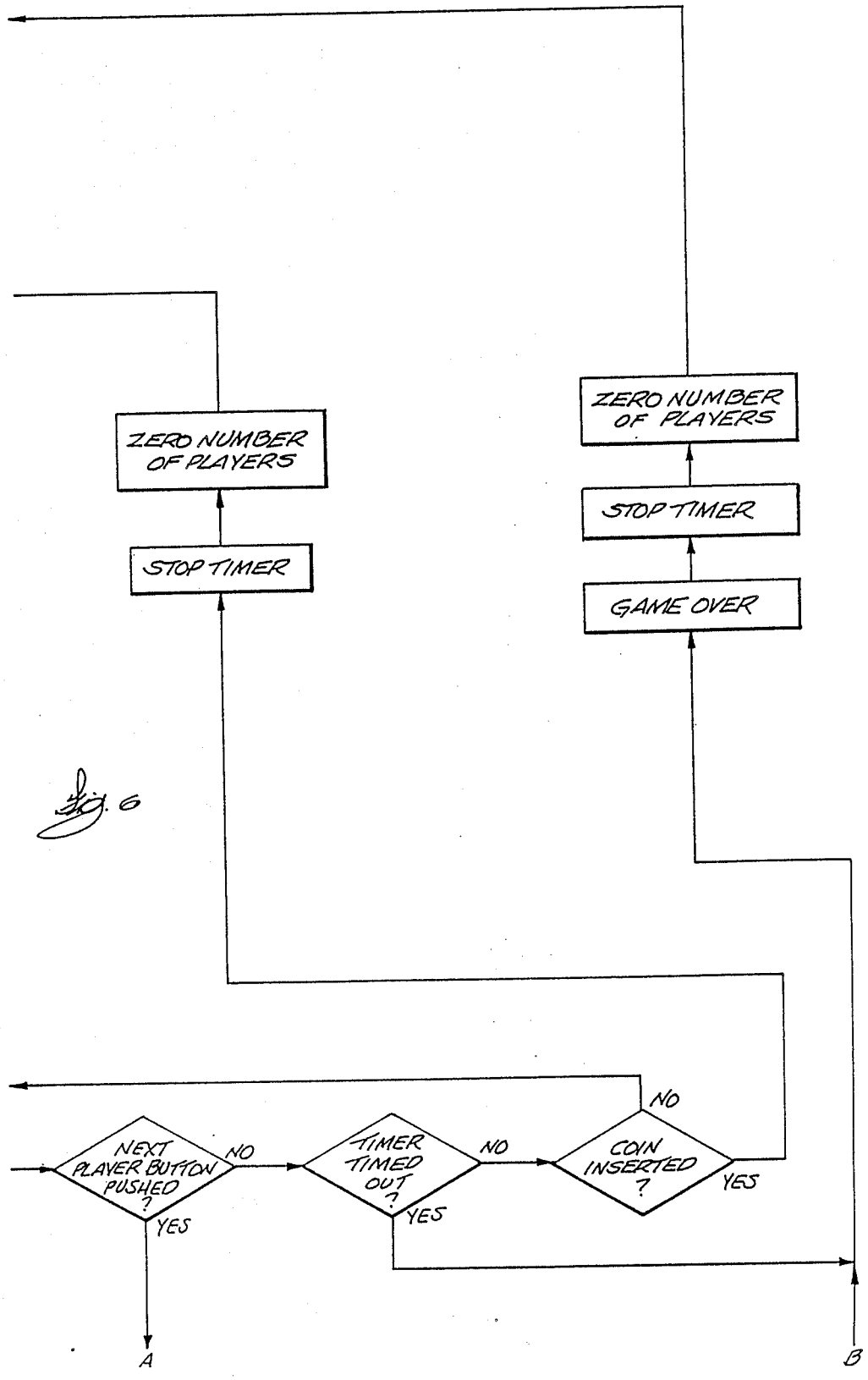
FIGS. 6A, 6B and 6C together form a flow diagram showing how the circuit shown in FIG. 5 controls the operation of the game to be played on the apparatus shown in FIG. 1.
Figure 6A:
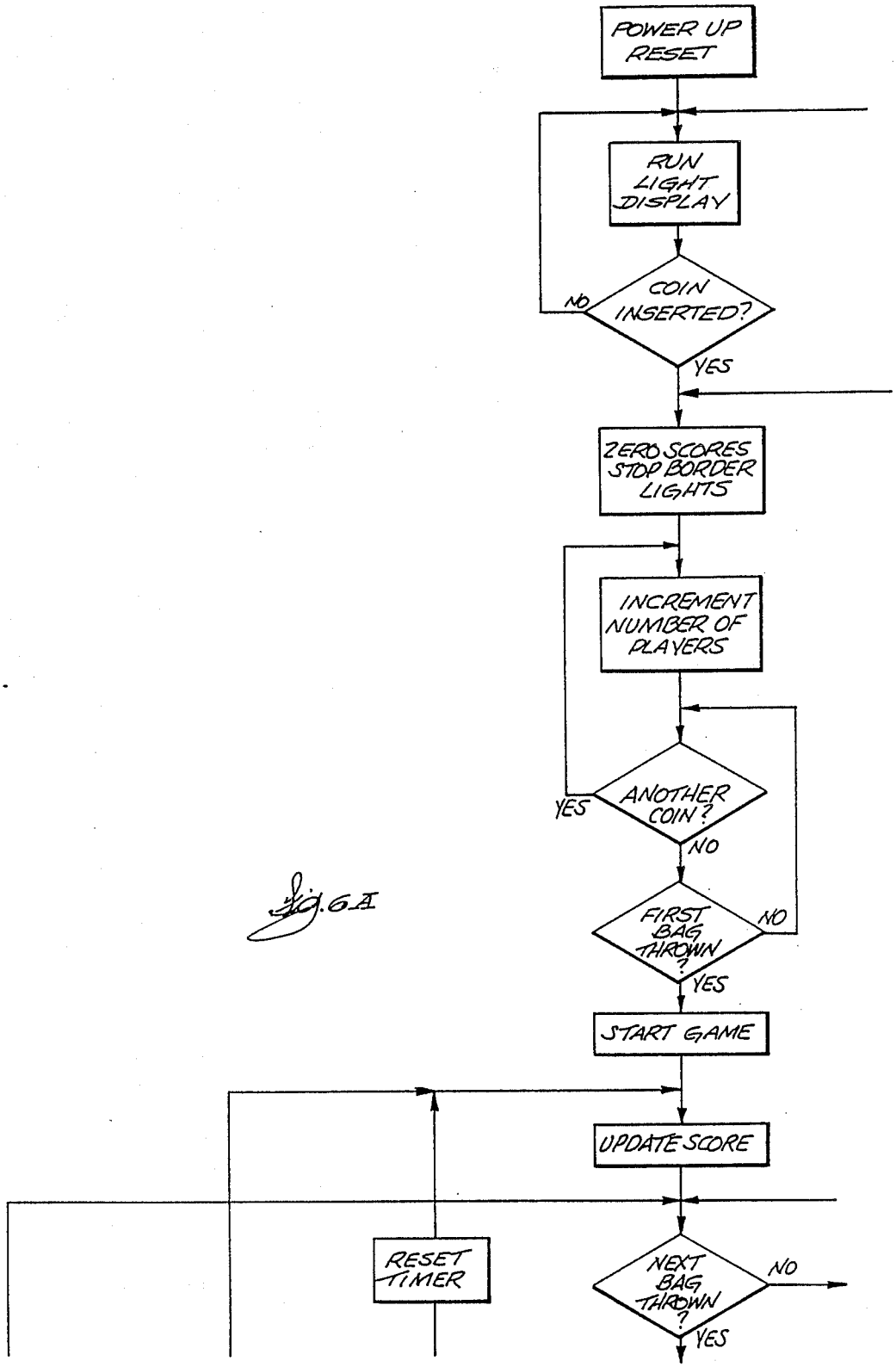
Figure 6B:
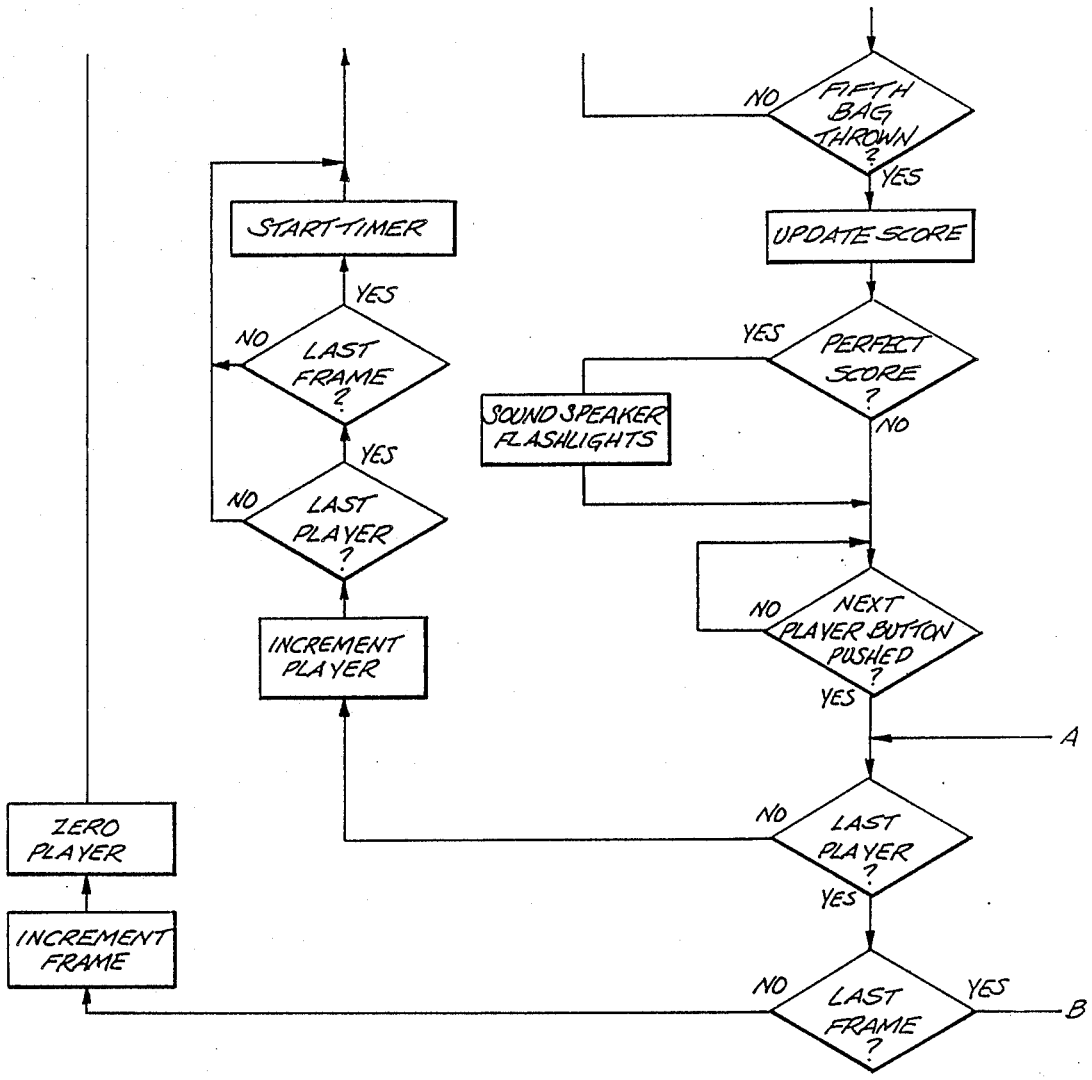

Another embodiment of the invention is shown in FIGS. 8, 9, 10 and 11, in combination with FIGS. 1 through 3. The logic, of course, is still as shown in FIGS. 6A, 6B and 6C.

Figure 8:
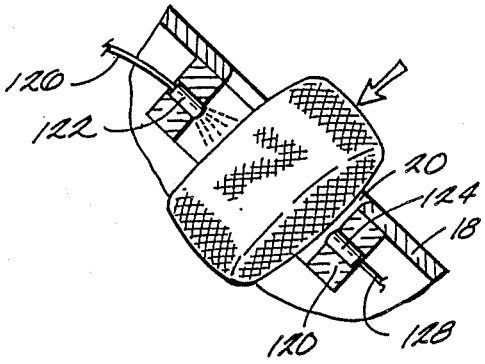
FIG. 8 is an enlarged view, similar to FIG. 4, showing a bag passing through a detector constructed according to another alternative embodiment of the invention.

Referring now to FIG. 8, as indicated earlier, the game board 18 includes a number of holes 20, formed generally normal to the surface of the game board. In the present embodiment, the game board 18 further includes, preferably positioned immediately beneath each hole 20, a light-activated sensing means 120. Each such light-activated sensing means 120 includes a light source 122 and a light sensor 124, positioned within the light-activated sensing means 120 in mutual facing relation. Light source 122 receives power to generate light via leads 126. Light sensor 124 generates a signal depending upon whether or not it is sensing the presence of light. In the most preferred embodiment, the light source 122 is a light-emitting diode (LED), while the light sensor 124 is a photo-transistor. Hence when nothing exists between the light source 122 and the light sensor 124, the light sensor senses light, in this case above a certain threshold, and it thus sends a signal to that effect over leads 128. Similarly, when a bag 22 passes between the light source 122 and the light sensor 124 of a particular hole 20, as is shown occurring in FIG. 8, the light sensor sends a signal to that effect.

Figure 9:
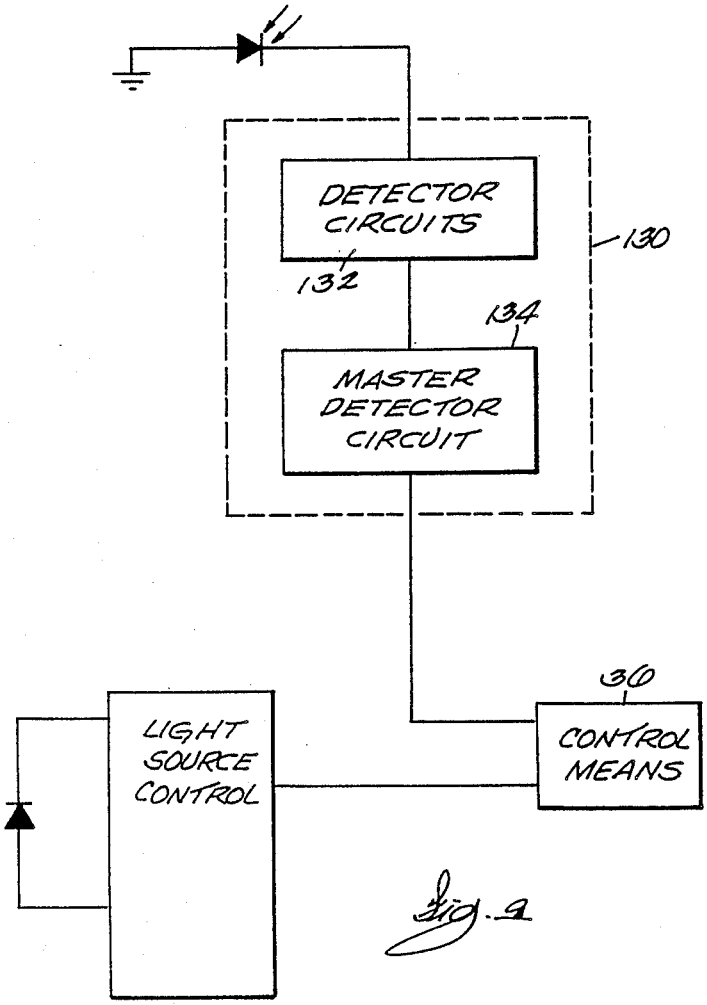
FIG. 9 is a schematic view of an alternative embodiment of an electronic circuit for controlling the display of the apparatus shown in FIG. 1, employing the detector shown in FIG. 8.

As shown in FIG. 9, each light sensor 124 is connected to a detection means 130, which in turn feeds a detection signal to the electronic control means 36. This detection signal is used by the electronic control means 36 to determine that a bag 22 has passed into a particular hole 20, having a particular predetermined score associated therewith, in a manner similar to that explained above with respect to the magnetically sensed embodiments.

FIG. 9 shows that the light sources 122 are powered by a light source control 132, which in turn is also controlled by control means 36. Further, as there shown, detection means 130 includes a number of like detector circuits 132, all connected to a master detector circuit 134.

Figure 10:
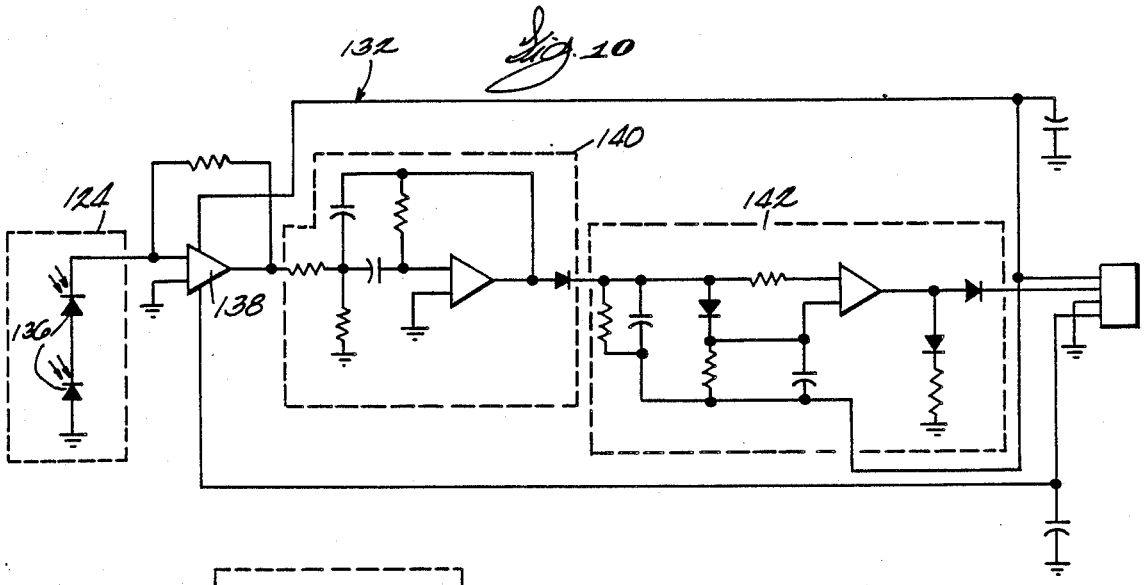
FIG. 10 is a schematic diagram of a detector circuit employed in the circuit shown schematically in FIG. 9.
Figure 11:
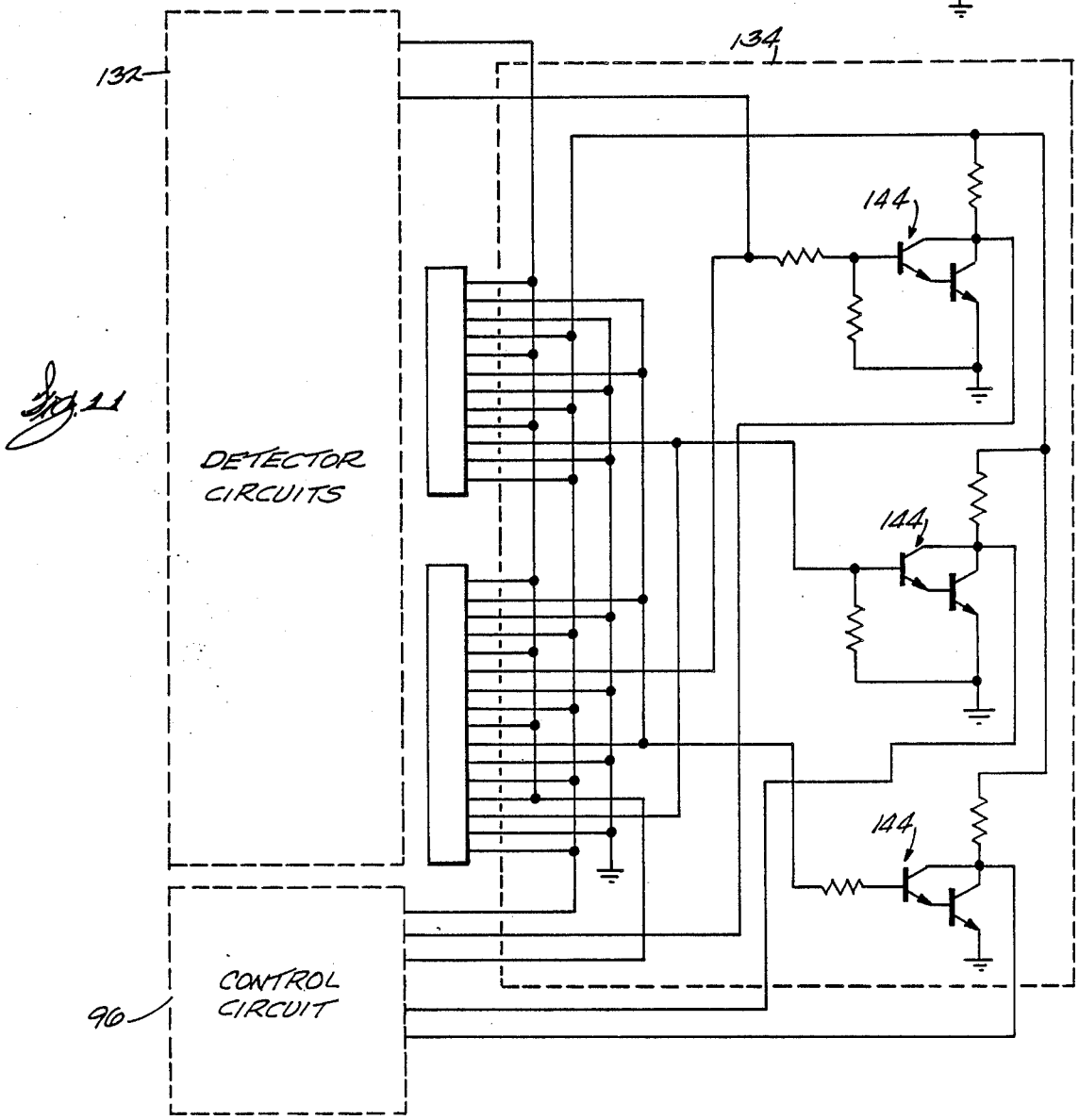
FIG. 11 is a schematic diagram of a master detector circuit employed in the circuit shown schematically in FIG. 9.

One detector circuit 132 is shown in more detail in FIG. 10, while the master detector circuit 134 is shown in more detail in FIG. 11. Referring now to FIG. 10, the signal from the light sensor 124, shown there as a pair of series photo-transistors 136, is first fed to a comparator 138, which in effect acts as a threshold detector. From there, the signal passes through a first stage 140 of amplification and then a second stage of amplification 142. It is then transmitted to the master detector circuit 134, FIG. 11. At the master detector circuit 134, the outputs from the individual detector circuits 132 are connected in common according to common point values of the respective holes. Each point value has a separate amplification stage 144 in the master detector 134. From the master detector 134 the signal is sent to the control circuit 96, already shown in detail in FIG. 7. As previously indicated, each point value then has a separate flip-flop 112 (FIG. 7), the output of which is connected to a respective input of the processor IC1 (FIG. 7) to indicate that a certain point value has been scored, as was the case with the magnetically sensed embodiments. Thereafter the respective point value is recorded and the total displayed as described with respect to the other embodiments. Hence by these circuits the signal caused by a bag 22 passing through a particular hole 20 is assigned a score within IC1, that score being added to the player's total score and displayed exactly as described with respect to FIGS. 5 and 7.

While the apparatus hereinbefore described is effectively adapted to fulfill the aforesaid objects, it is to be understood that the invention is not intended to be limited to the specific preferred embodiment of electronic bag toss game set forth above. Rather, it is to be taken as including all reasonable equivalents within the scope of the following claims.

We claim:

1. An automated bag toss game, comprising:

a game board surface, having a plurality of holes formed therein;

at least one item to be tossed:

light-activated sensing means, disposed generally beneath said game board surface and aligned with said holes, for sensing the passage of said item into one of said holes and producing a signal corresponding to the particular hole into which the item passed.

2. An automated bag toss game as recited in claim 1 wherein said light-activated sensing means includes a light source and a light sensing means generally positioned to be aligned with each other and beneath each of said holes.

3. An automated bag toss game as recited in claim 1 further comprising electronic means for receiving said signal and for displaying a score based upon the particular hole into which the item passed.

4. An automated bag toss game as recited in claim 3 wherein said electronic means further comprises:

display means for displaying a score corresponding to the holes into which items have been thrown; and display driving means for receiving a signal from said light-activated sensing means corresponding to a predetermined hierarchy of said holes in said game board and producing a signal for driving said display to show a score corresponding to the holes into which any items have fallen.

5. An automated bag toss game, comprising:

a game board surface, having a plurality of holes formed therein, each hole being assigned a predetermined point value, there being a plurality of different point values of holes on the game board surface;

at least one item for being tossed into the holes from a distance;

light-activated sensing means, disposed generally beneath said game board surface and aligned with said holes, for sensing the passage of said item into one of said holes and producing a signal corresponding to the particular hole into which the item passed.

6. An automated bag toss game as recited in claim 5 further comprising electronic means for said signal and for displaying a score based upon the values assigned to the particular holes into which thrown items have fallen.

7. An automated bag toss game as recited in claim 6 wherein said electronic means further comprises:

display means for displaying a score corresponding to the total of the values assigned to the holes into which said items have been thrown; and display driving means for receiving a signal from said light-activated sensing means corresponding to said predetermined point value of said holes in said game board and producing a signal for driving said display to show a score based upon the values assigned to the particular holes into which thrown items have fallen.

8. An automated bag toss game as recited in claim 5 wherein said light-activated sensing means includes a light source and a light sensor generally positioned in opposed facing relation and beneath each of said holes.

* * * * *

UNITED STATES PATENT AND TRADEMARK OFFICE

CERTIFICATE OF CORRECTION

PATENT NO. : 4,927,160

DATED : May 22, 1990

INVENTOR(S) : Nichol et al.

It is certified that error appears in the above—identified patent and that said Letters Patent is hereby corrected as shown below:

Column 10, Line 26:

After "for" and before "said
insert --- receiving ---.

Signed and Sealed this

Third Day of September, 1991

*Attest:*

*Attesting Officer*

HARRY F. MANBECK, JR.

*Commissioner of Patents and Trademarks*